United States Patent [19]

Finn

[11] 4,072,070

[45] Feb. 7, 1978

[54] REMOTE ACCESS WASHER WITH BOLT ALIGNMENT TOOL

[75] Inventor: Arthur Francis Finn, Vienna, Va.

[73] Assignee: The United States of America as represented by the Secretary of the Navy, Washington, D.C.

[21] Appl. No.: 715,037

[22] Filed: Aug. 17, 1976

[51] Int. Cl.[2] ..... B25B 13/48

[52] U.S. Cl. ..... 81/71; 81/125; 85/50 R

[58] Field of Search ..... 81/71; 85/50 R, 51; 29/271

[56] References Cited

U.S. PATENT DOCUMENTS

| | | | |
|---|---|---|---|
| 1,746,825 | 2/1930 | Fabel | 81/71 |
| 2,817,258 | 12/1957 | Stein | 81/71 |
| 3,045,785 | 7/1962 | Ferguson | 85/50 R |
| 3,605,508 | 9/1971 | Fell | 81/71 X |

*Primary Examiner*—James L. Jones, Jr.
*Assistant Examiner*—James G. Smith
*Attorney, Agent, or Firm*—R. Sciascia; R. Beers; S. Sheinbein

[57] ABSTRACT

An aligning apparatus for inserting a bolt and a washer in a remote or restricted place for securing equipment. A standard washer is permanently attached to the end of tubing, a bolt is inserted in the tubing through the washer and held in position by a tool inserted in the tubing, mating with the bolt. This combination is placed in alignment with a normally inaccessible threaded hole. The bolt is turned into the hole and secured by a torquing action on the tool. For the reverse process, removal tabs are attached to the tubing to accomplish intact extraction of the bolt, washer, and tubing.

3 Claims, 2 Drawing Figures

REMOTE ACCESS WASHER WITH BOLT ALIGNMENT TOOL

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates to apparatus for bolting equipment to a solid base, and more particularly to an alignment tube which reaches a remote or restricted threaded hole and an extension tool which is designed to fit within the alignment tube and mate with a bolt constrained by the washer and rotate so as to either tighten or loosen the bolt.

Numerous pieces of equipment are commonly affixed to a solid base with bolts and washers. Normally the bolt is slid through the washer and this loose combination is then passed through a hole in the equipment, started in a threaded hole in the base and tightened by a wrench or other appropriate tool. In many cases, the holes are either remote or have restricted access. When standard wrenches and washers are used, alignment of the bolt, washer, and base hole is not only tedious, but there is a great tendency to drop the bolt and washer and lose either or both parts. Even if alignment is eventually effected, reaching and tightening the bolt with a standard wrench are time consuming and frustrating tasks. If equipment removal is ever desired, the current method does not provide for retrieving the loosened bolt and washer. As a result these parts are never recycled and may even contribute to dangerous conditions wherein these loose materials could damage electrical or mechanical equipment.

SUMMARY OF THE INVENTION

Accordingly, the present invention provides an alignment tube and extension tool for loosening and removing or aligning and tightening a bolt and washer in a remote or restricted threaded hole. The extension tool slides inside the alignment tube, mates with a bolt contained therein and is rotated so as to tighten the bolt in the intended hole, thereby securing equipment to a solid base. When equipment replacement or removal is desired, the extension tool is used to loosen the bolt and then both the alignment tube and the bolt are extracted from the hole by pulling on the removal tabs.

OBJECTS OF THE INVENTION

It is therefore an object of the present invention to provide an alignment tube and extension tool to hold a bolt firmly for alignment and insertion into a threaded hole in a remote or restricted area.

A further object of the present invention is to tighten normally inaccessible bolts and washers with a minimum amount of time and effort.

Another object of the present invention is to increase equipment installation efficiency.

Yet another object of the present invention is to provide for loosening and retrieving washers and bolts from remote or restricted, normally inaccessible holes.

Still a further object of the present invention is to prevent dropping and losing bolts and washers.

BRIEF DESCRIPTION OF THE DRAWINGS

Other objects and many of the attendant advantages of this invention will be readily appreciated as the same becomes better understood by reference to the following detailed description when considered in connection with the accompanying drawings, wherein.

DESCRIPTION OF THE PREFERRED EMBODIMENT

Figure 1:
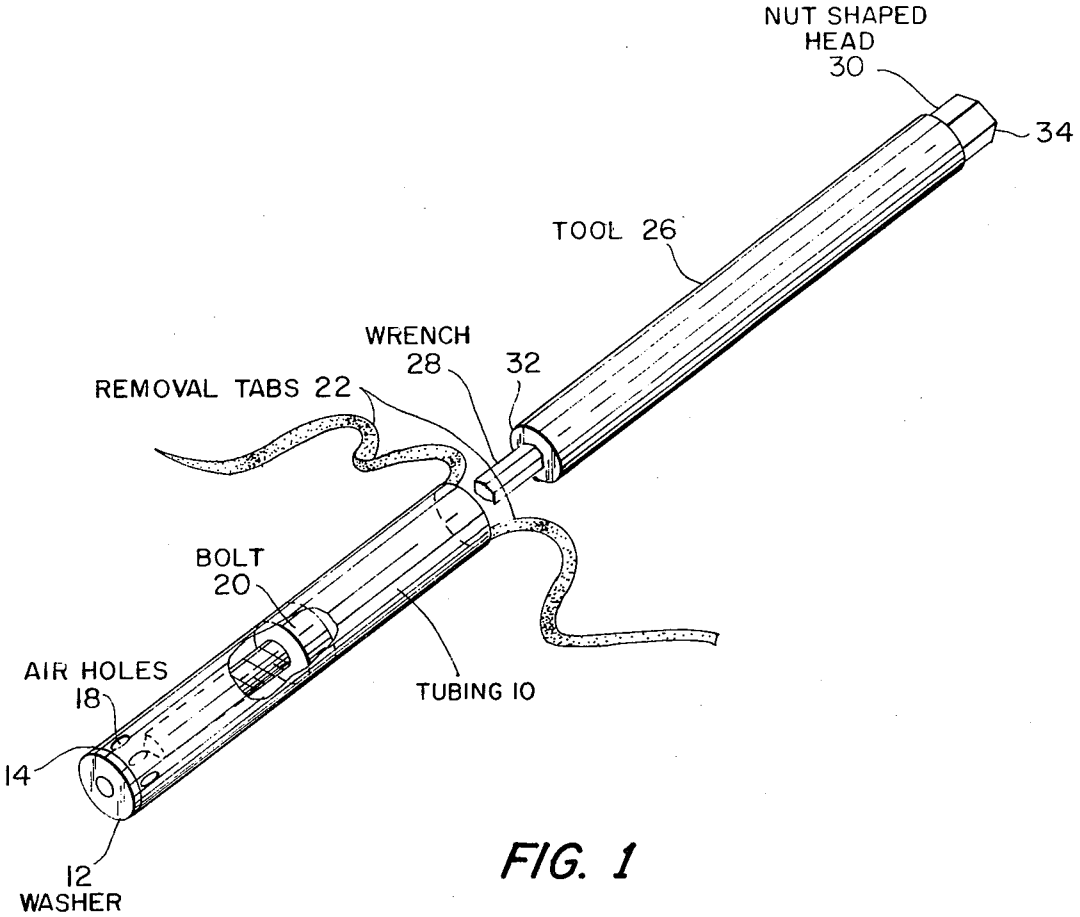
FIG. 1 is an exploded perspective view of the alignment tube bolt extension tool.

Referring now to the drawings, wherein like numbers represent the same components in each figure, and more particularly to FIG. 1, a hollow cylindrical alignment tubing 10 and bolt extension tool 26 are shown. A standard washer 12 is permanently affixed by any conventional manner, such as epoxy, heat, mechanical pressure, or the like, at end 14 of alignment tubing 10. Bolt 20, having a head diameter smaller than the inside diameter of alignment tubing 10 is shown partially inserted within tubing with its head facing end 16. Alignment tubing 10 can be constructed so as to have a plurality of holes 18, circumferentially located around end 14 to relieve the pressure created by complete insertion of bolt 20 against the washer 12, by the bolt extension tool 26. To facilitate eventual removal of washer 12 and bolt 20, tabs 22 are affixed to alignment tubing 10, at, or near, end 16.

Bolt extension tool 26 includes an allen-shaped wrench 28 to fit bolt head 20 at one end and a standard nut-shaped head 30 at its other end to receive a socket wrench. The outside diameter of tool 26 is minutely smaller than the inside diameter of alignment tubing 10. Any appropriate semi-rigid material such as a plastic or a metal may be used to fabricate tubing 10 and removal tabs 22, while an appropriate metal is used to fabricate the washer 12. A bolt extension tool 26 is fabricated from steel and then hardened. The wrench shape 28 may either be machined from end 32 of tool 26 or permanently attached to end 32 by any appropriate means. Likewise, a nut-shaped head 30 can either be machined from end 34 of tool 26 or permanently attached thereto by any appropriate means.

Figure 2:
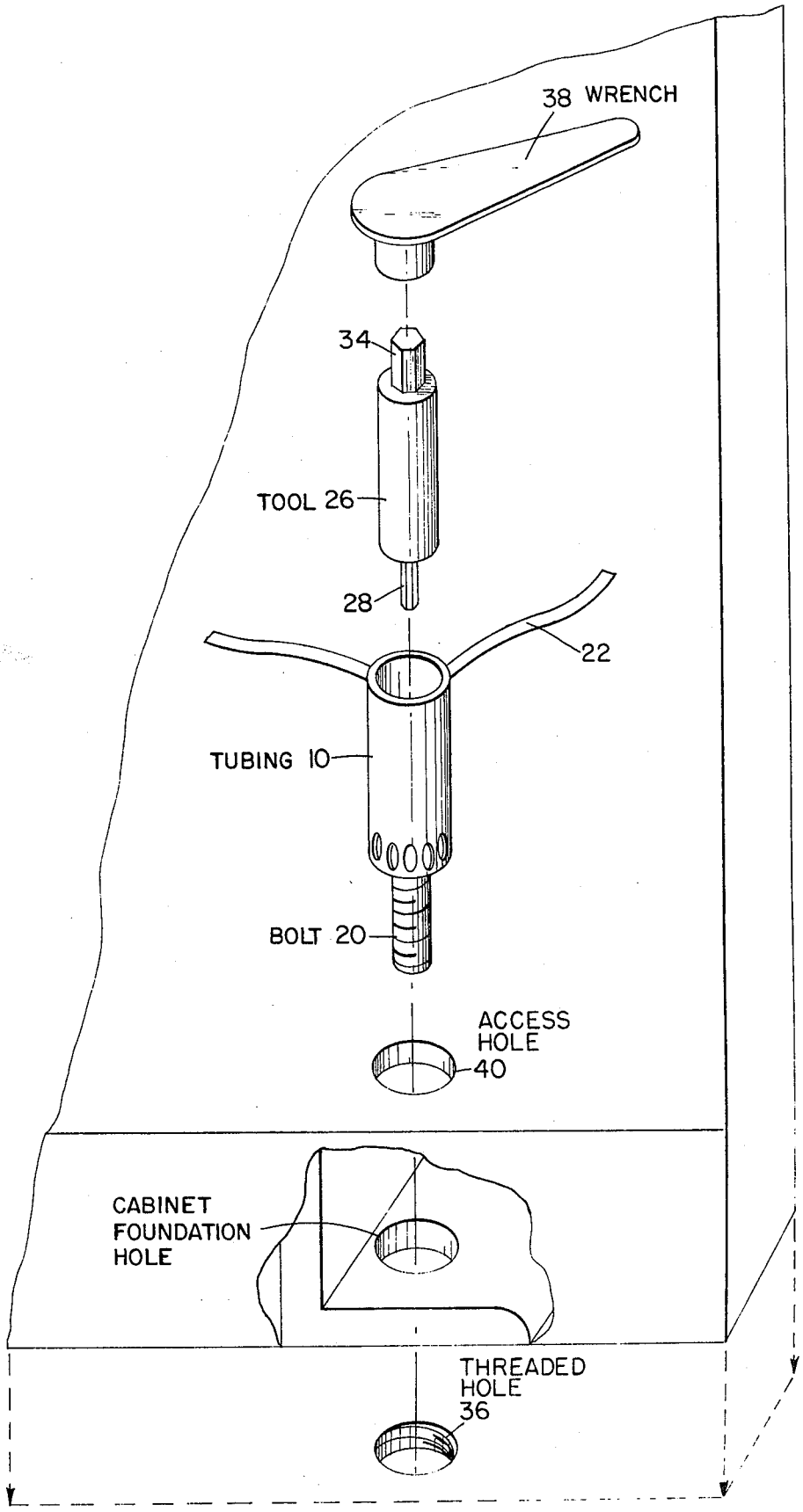
FIG. 2 is a sectional view of a typical application of the invention.

Referring now to FIG. 2, in operation, bolt 20 is inserted through tubing 10 and extended beyond the washer end. inserted through tubing 10 and extended beyond the washer end. Bolt extension tool 26 is then inserted through tubing 10 and mated with bolt 20. This rigid assembly is then aligned with a threaded base hole 36 and inserted through equipment access hole 40 and threading of bolt 20 into base hole 36 is effected. Bolt 20 is tightened firmly, and a standard socket wrench 38 or any other appropriate tool may then be mated with nut-shaped end of bolt extension tool 26 and used to effect final tightening.

Thus it is apparent that there is provided by this invention an alignment tube with bolt extension tool for positioning and tightening or loosening and removing a bolt and washer in a remote or restricted, normally inaccessible threaded hole, with a minimum of time and effort.

It is to be understood that what has been described is merely illustrative of the principles of the invention and that numerous arrangements in accordance with this invention may be devised by one skilled in the art without departing from the spirit and scope thereof.

What is new and desired to be secured by Letters Patent of the United States is:

1. Apparatus for aligning and tightening, comprising, in combination:

a bolt;

a washer;

an alignment tube, said washer affixed to one end of said tube, said bolt inserted into said tube, the head of said bolt facing the other end of said tube; and an extension tool having an outside diameter minutely smaller than the inside diameter of said tube, thereby permitting said tool to be inserted into and rotated within said tube, said tool being shaped at one end so as to mate with said bolt and being nut-shaped at the other end for receiving a wrench;

whereby said bolt and said washer may be aligned and tightened in a remote or restricted, normally inaccessible hole.

2. The apparatus of claim 1, further including a plurality of holes around the circumference of said tube adjacent said washer to relieve air pressure created within said tube during tightening.

3. The apparatus of claim 1, whereinsaid extension tool is hexagonal shaped at its lower end for insertion into said bolt, wherein said bolt is placed completely within said tube, and wherein tabs are attached to said other end of said tube to facilitate removal of said washer and said bolt.

* * * * *